US009022778B2

(12) United States Patent
Schlachter et al.

(10) Patent No.: US 9,022,778 B2
(45) Date of Patent: May 5, 2015

(54) SIGNAL CONDITIONER FOR USE IN A BURNER CONTROL SYSTEM

(75) Inventors: John James Schlachter, Leonard, MI (US); Lynn E. Cooper, North Richland Hills, TX (US)

(73) Assignee: Maxitrol Company, Southfield, MI (US)

( * ) Notice: Subject to any disclaimer, the term of this patent is extended or adjusted under 35 U.S.C. 154(b) by 1155 days.

(21) Appl. No.: 12/410,806

(22) Filed: Mar. 25, 2009

(65) Prior Publication Data

US 2009/0246720 A1 Oct. 1, 2009

Related U.S. Application Data

(60) Provisional application No. 61/039,642, filed on Mar. 26, 2008.

(51) Int. Cl.
*F23N 5/20* (2006.01)
*F23N 5/02* (2006.01)
*F23N 5/24* (2006.01)

(52) U.S. Cl.
CPC ..... *F23N 5/203* (2013.01); *F23N 5/022* (2013.01); *F23N 5/242* (2013.01); *F23N 2025/14* (2013.01); *F23N 2025/21* (2013.01); *F23N 2027/02* (2013.01)

(58) Field of Classification Search
CPC ..... F23C 7/008; F23N 1/002; F23N 2023/08; F23N 2023/22; F23N 2027/02; F23N 5/022; F23N 5/082; F23N 5/123; F23N 5/206; F23N 5/203; F23N 5/242
USPC ..... 431/72, 73, 74, 75; 126/39 BA, 116 A; 363/147
See application file for complete search history.

(56) References Cited

U.S. PATENT DOCUMENTS

| | | | | |
|---|---|---|---|---|
| 1,961,386 | A * | 6/1934 | Payne | 137/554 |
| 2,461,608 | A * | 2/1949 | Laing | 236/68 R |
| 3,728,797 | A * | 4/1973 | Worden et al. | 34/468 |
| 3,954,383 | A | 5/1976 | Bryant | |
| 4,140,274 | A * | 2/1979 | Nabinger | 236/11 |
| 4,381,075 | A * | 4/1983 | Cargill et al. | 237/8 R |
| 4,578,583 | A * | 3/1986 | Ciammaichella et al. | 250/372 |
| 4,746,807 | A * | 5/1988 | Furo et al. | 290/40 C |
| 4,828,484 | A | 5/1989 | Youtz | |
| 5,294,051 | A * | 3/1994 | Piegari | 237/8 R |
| 5,538,416 | A * | 7/1996 | Peterson et al. | 431/46 |
| 5,648,008 | A * | 7/1997 | Barritt et al. | 219/626 |
| 5,865,618 | A * | 2/1999 | Hiebert | 432/222 |
| 5,951,276 | A * | 9/1999 | Jaeschke et al. | 431/66 |
| 6,335,572 | B1 * | 1/2002 | Uno et al. | 290/1 R |
| 6,862,165 | B2 * | 3/2005 | Chian et al. | 361/160 |
| 6,959,876 | B2 * | 11/2005 | Chian et al. | 236/68 D |

(Continued)

*Primary Examiner* — Jorge Pereiro
(74) *Attorney, Agent, or Firm* — Howard & Howard Attorneys PLLC

(57) ABSTRACT

A signal conditioner for use with a controller and a burner receives an input signal from the controller. A conversion circuit generates a primary output signal corresponding to the input signal to control the burner. The signal conditioner also includes a delay circuit. The delay circuit overrides the primary output signal generated by the conversion circuit and substitutes a delay signal to the burner at a predetermined level for a predetermined time. The signal conditioner may also include a temperature override circuit, which receives a temperature of air from the burner. If the temperature is above or below established limits, the temperature override circuit substitutes a temperature override signal to the burner.

13 Claims, 5 Drawing Sheets

(56) References Cited

U.S. PATENT DOCUMENTS

| | | | | |
|---|---|---|---|---|
| 7,317,265 | B2 * | 1/2008 | Chian et al. | 307/151 |
| 7,553,151 | B2 * | 6/2009 | O'Mara et al. | 431/62 |
| 7,554,828 | B2 * | 6/2009 | Wilson | 363/146 |
| 7,701,739 | B2 * | 4/2010 | Mollo | 363/142 |
| 2005/0141252 | A1 * | 6/2005 | Mollo | 363/101 |
| 2006/0257803 | A1 | 11/2006 | Schlachter et al. | |
| 2006/0266229 | A1 * | 11/2006 | Ribich | 99/486 |
| 2007/0204846 | A1 * | 9/2007 | O'Mara et al. | 126/116 A |
| 2010/0192939 | A1 * | 8/2010 | Parks | 126/39 BA |

* cited by examiner 30
10
$V_{CC}$
78L12
32
SA555
A
42
38
44
B
C
D
34
RTD
40
E
F

SIGNAL CONDITIONER FOR USE IN A BURNER CONTROL SYSTEM

CROSS REFERENCE TO RELATED APPLICATION

This application claims the benefit of provisional patent application No. 61/039,642, filed Mar. 26, 2008, which is hereby incorporated by reference.

BACKGROUND OF THE INVENTION

1. Field of the Invention

The present invention relates to a signal conditioner. Specifically, the invention relates to a signal conditioner that converts electrical control signals in a burner control system.

2. Description of the Related Art

Automatic controllers, such as microprocessor-based devices, are commonly used to control mechanical devices. Such is the case in modern Heating, Ventilation, and Air Conditioning (HVAC) systems, where a controller is often utilized to control heating devices (e.g., burners), airflow fans, heat exchangers, louvers, and the like. The control of these devices is typically based on a plurality of inputs, such as desired temperature setpoints, temperature sensors, time clocks, and fault monitoring. The controller then typically produces one or more output signals that are used to control the mechanical devices of the HVAC system.

Often, the signal or signals produced by the controller are not compatible with the mechanical device to which they are intended control. For example, the controller may produce a variable 4-20 mA signal while a valve requires a variable 0-10 V signal. In such cases a signal conditioner, also known as a signal converter, may be used to condition, i.e., convert, the signal produced by the controller to one that may be utilized by the mechanical device.

The automatic controllers of HVAC systems have other drawbacks as well. For instance, during start-up and/or power restoration to an HVAC system, the output signals provided by the controller could damage the mechanical device and/or result in inefficient operation. Furthermore, failure in a temperature sensor or a program fault may result in the over heating or under heating of a burner and the entire HVAC system.

The present invention is aimed at solving one or more of these deficiencies or other deficiencies in the prior art.

SUMMARY OF THE INVENTION AND ADVANTAGES

The invention provides a signal conditioner for use with a controller and a burner. The signal conditioner includes a signal input electrically connectable to the controller for receiving a input signal from the controller. A signal output is electrically connectable to the burner for sending an output signal to the burner. A conversion circuit is electrically connected to the signal input and the signal output for generating a primary output signal corresponding to the input signal as the output signal. A delay circuit is electrically connected to the conversion circuit and the signal output for overriding the primary output signal generated by the conversion circuit and generating a delay signal at a predetermined level for a predetermined period of time as the output signal.

The invention also provides a temperature input for receiving a temperature of air discharged from the burner. A temperature override circuit is electrically connected to the temperature input and the signal output. In response to the temperature of air being outside at least one predetermined limit, the temperature override circuit overrides the primary output signal supplied by the conversion circuit and generates a temperature override signal at a predetermined level as the output signal.

By providing the delay circuit, the signal conditioner of the present invention prevents a possibly hazardous output signal from reaching the burner during start-up, thus safeguarding equipment and guarding against injury. Furthermore, by providing the temperature override circuit, the signal conditioner of the present invention prevents the burner from providing excessively high or low heating due to malfunctions in the controller or for energy management purposes.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
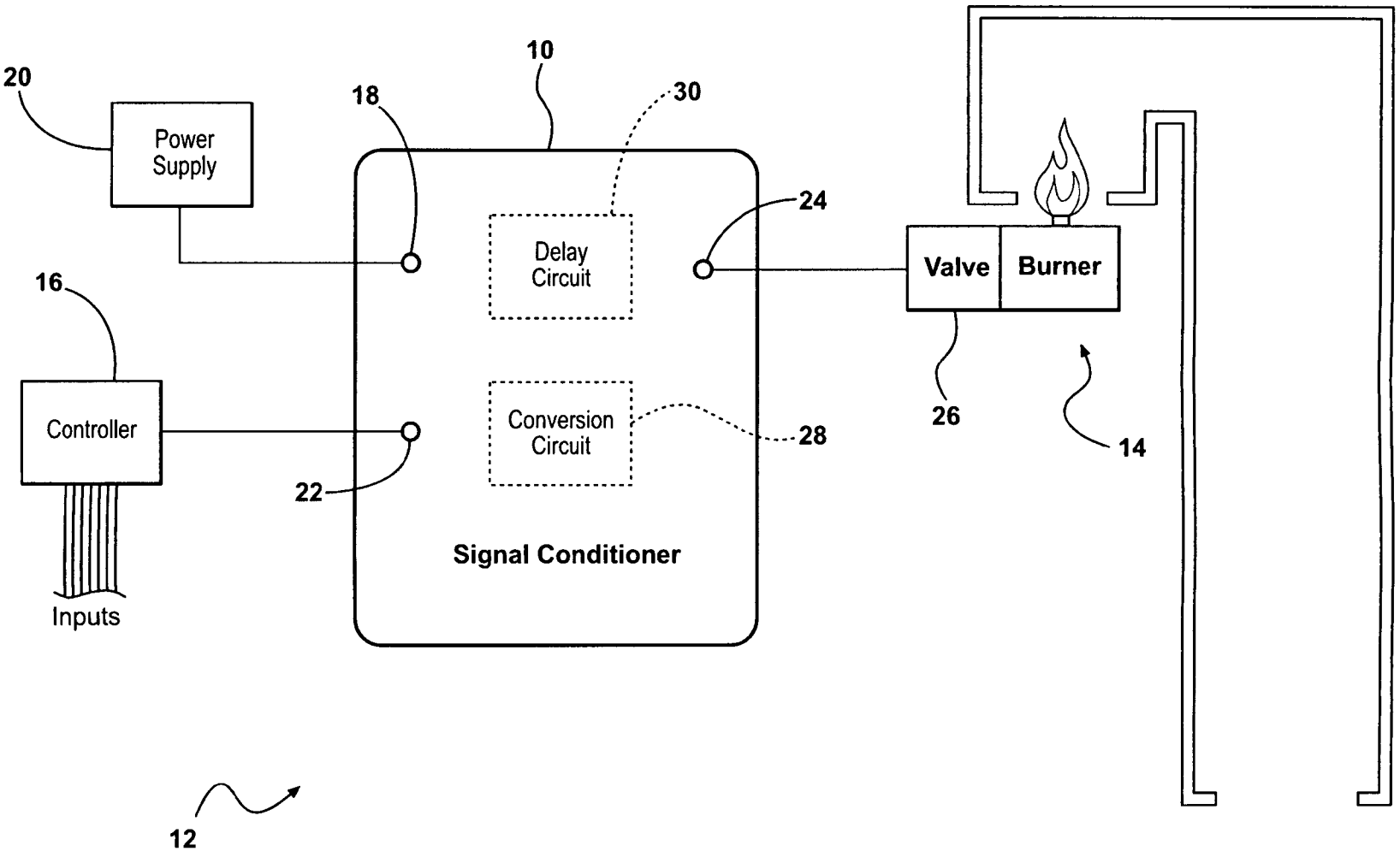
FIG. 1 is a schematic block diagram of a first embodiment of a signal conditioner of the subject invention as part of a control system of a burner.
Figure 2:
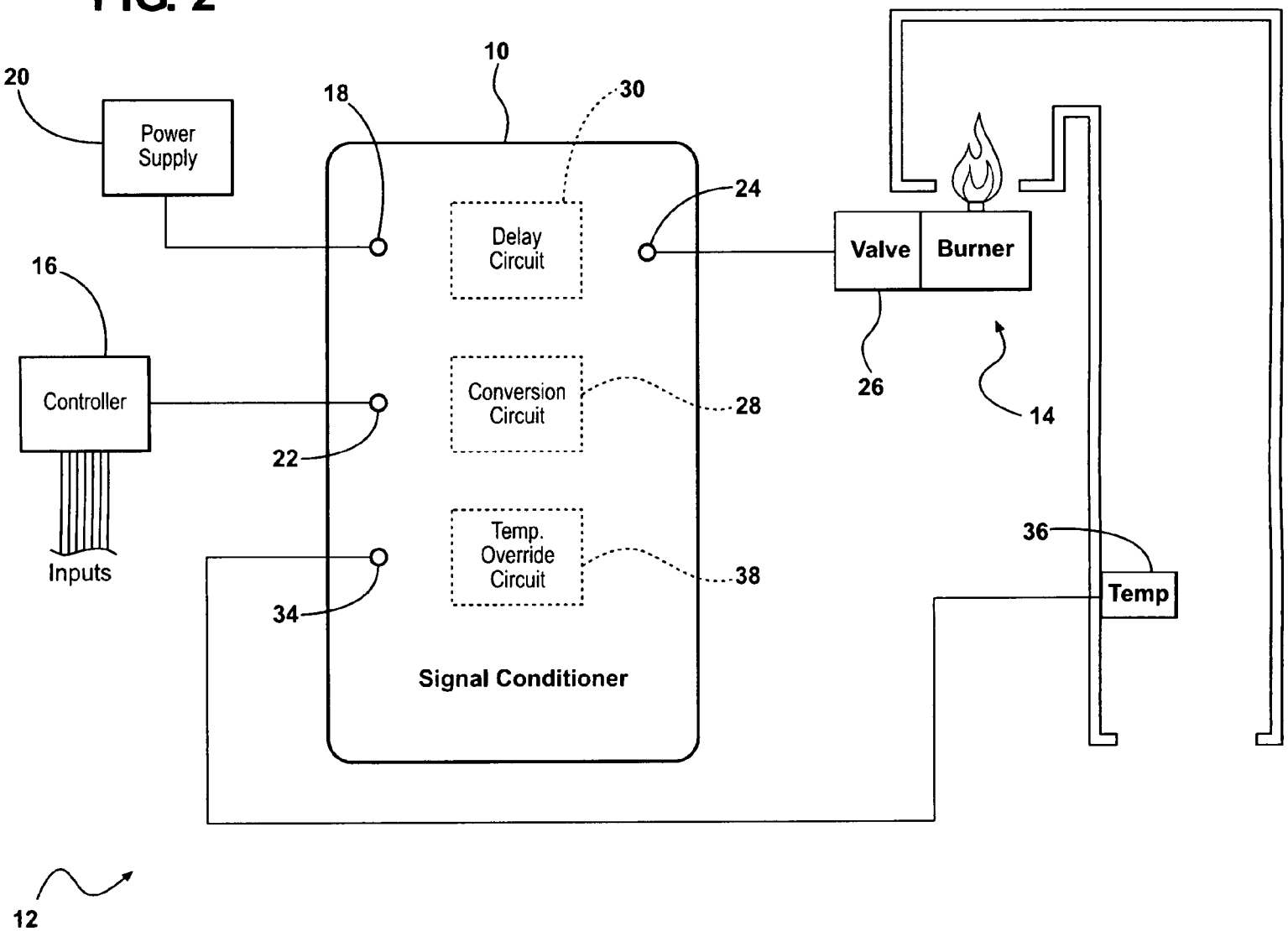
FIG. 2 is a schematic block diagram of a second embodiment of the signal conditioner of the subject invention as part of the control system of the burner.

Referring to the Figures, wherein like numerals indicate like parts throughout the several views, a signal conditioner is shown at 10. In the illustrated embodiments, as shown in FIGS. 1 and 2, the signal conditioner 10 is shown as part of a control system 12 of a burner 14, specifically for heating air, such as in HVAC installations (not shown in detail). However, those skilled in the art realize that the signal conditioner 10 described herein may be implemented in other applications outside of the control of burners.

The control system 12 of the illustrated embodiment includes a controller 16 for controlling operation of the burner 14. The controller 16 controls operation of the burner 14 based on a variety of inputs known to those skilled in the art including, but not limited to, control signals, temperature setpoint, and temperature sensors. In response to these inputs, the controller 16 produces at least one controller output signal for operating the burner 14. The controller 16 may include a microprocessor (not shown) running a program, as is well known to those skilled in the art, for analyzing the inputs and producing the controller output signal based on the programming and the inputs.

The signal conditioner 10 includes a power supply input 18 for receiving electrical power. In the illustrated embodiment, the electrically power is supplied by a power supply 20. The electrical power supplied by the power supply 20 is 24 VAC at 50/60 Hz, as is required by the signal conditioner of the illustrated embodiments. However, those skilled in the art realize that in other embodiments the signal conditioner may receive different forms and levels of electrical power.

The signal conditioner 10 is electrically connectable to the controller 16. Specifically, the signal conditioner 10 includes a signal input 22 electrically connectable to the controller 16 for receiving an input signal from the controller 16. The input signal received by the signal conditioner 10 is the controller output signal produced by the controller 16.

The signal conditioner 10 also includes a signal output 24 electrically connectable to the burner 14 for sending an output signal to the burner 14. More specifically, in the illustrated embodiments, the signal output 24 is electrically connectable to a gas valve 26 of the burner 14. The gas valve 26 adjusts the flow of gas to the burner 14 based on the output signal, and thus controls the amount of heat produced by the burner 14.

The input and output signals of the signal conditioner 10 each have a high limit and a low limit. The high and low limits correspond to an electrical characteristic of the signal. For example, the input signal may be variable between 4 and 20 mA. The high limit may be 20 mA while the low limit may be 4 mA. Those skilled in the art realize that these limits may be reversed, i.e., the high limit may be 4 mA while the low limit may be 20 mA. Also, in the illustrated embodiment, the high and low limits also correspond to the desired operating state of the burner 14. For example, when the input signal is 4 mA, it is desired that the burner 14 operate at its lowest heat producing setting while when the input signal is 20 mA, it is desired that the burner 14 operate at its highest heat producing setting. Obviously, this situation may be reversed as described above.

The signal conditioner 10 includes a conversion circuit 28 electrically connected to the signal input 22 and the signal output 24 for generating a primary output signal corresponding to the input signal. Said another way, the conversion circuit 28 converts the input signal from a first type of electrical signal to a second type of electrical signal, i.e., the primary output signal. This primary output signal is normally provided to the signal output 24 of the signal conditioner 10, i.e., the signal that is supplied to the gas valve 26 of the burner 14, except as detailed below. For instance, the input signal may vary between 4 to 20 mA, based on the output of the controller 16, while the primary output signal may vary between 0 to 20 V, which is then usable by the gas valve 26. In the illustrated embodiments, the primary output signal ranges from 0 to 20 V while the input signal ranges between 4 to 20 mA or 0 to 10 V. Of course, other ranges for the signals may be implemented as realized by those skilled in the art.

In the illustrated embodiments, the primary output signal is proportional to the input signal, as is realized by those skilled in the art. For instance, where the signal conditioner 10 is configured for a 4 to 20 mA input, when the input signal is 4 mA, the primary output signal is 20 V; when the input signal is 12 mA, the primary output signal is 10 V; and when the input signal is 20 mA, the primary output signal is 0 V.

The signal conditioner of the illustrated embodiments also includes a delay circuit 30 electrically connected to the conversion circuit 28 and the signal output 24 for overriding the primary output signal generated by the conversion circuit 28 and generating a delay signal at a predetermined level for a predetermined period of time as the output signal. Said another way, the primary output signal generated by the conversion circuit is suppressed for the predetermined period of time in favor of the delay signal. During this predetermined period of time, the delay signal is provided to the signal output 24. In the illustrated embodiments, the delay signal is either 0 V or 20 V, selectable by the user, based on the configuration of the gas valve 26. However, those skilled in the art realize other configurations for the delay signal depending on the specific application. Furthermore, the predetermined level of the delay signal preferably corresponds to that desired for igniting the burner 14.

The delay circuit 30 is also electrically connected to the power supply input 18. Furthermore, the predetermined period of time when the electrical power is received by the delay circuit begins when electrical power is sensed on the power supply input 18. As such, the delay signal is active for the predetermined period of time when the signal conditioner 10 is initially powered up. This helps prevent spurious start-up signals generated by the controller 16 from reaching the burner 14, thus protecting the burner and other equipment from unintended damage and/or failure.

The predetermined period of time of the delay circuit 30, i.e., the delay time, is adjustable by a user. Specifically, in the illustrated embodiments, a potentiometer 32 is used to adjust the delay time between 5 and 30 seconds. However, those skilled in the art realize that other ranges for the delay time may be implemented. Furthermore, as stated above, the output signal may be variable between the low limit and the high limit. The delay circuit 30 is configurable with jumpers (not labeled) such that the delay signal is set at either the low limit or the high limit during the delay time.

Figure 3:
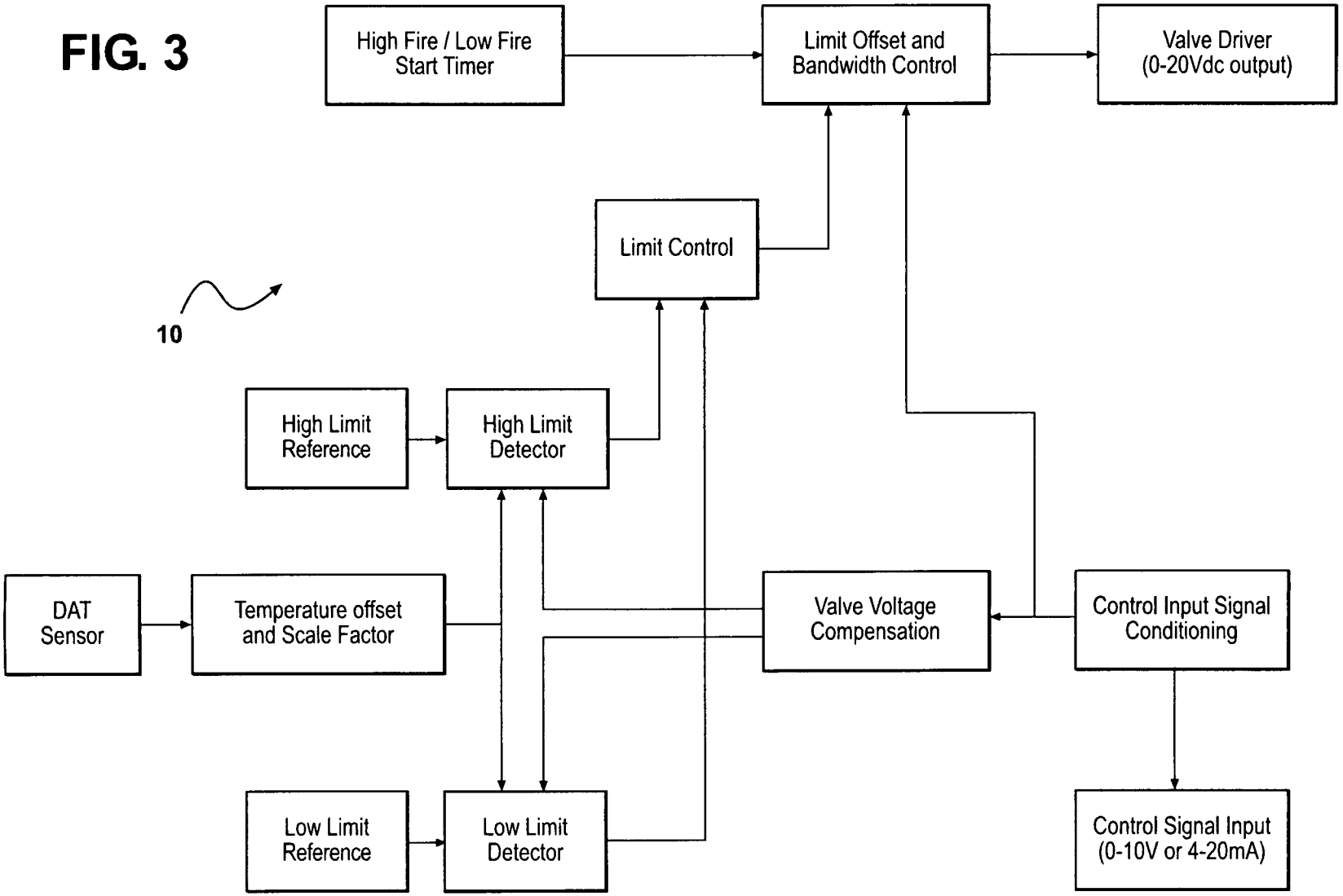
FIG. 3 is an alternative representation of a schematic block diagram of the second embodiment of the signal conditioner of the subject invention.

In a second embodiment, as shown in FIGS. 2-4, the signal conditioner 10 includes a temperature input 34 for receiving a temperature of air. The temperature of air is provided by a temperature sensor 36, such as, but not limited to, an RTD or thermocouple. In the illustrated embodiment, the temperature of air is that of the air discharged from the burner 14. However, other suitable locations for the temperature sensor are realized by those skilled in the art.

The signal conditioner 10 also includes a temperature override circuit 38 electrically connected to the temperature input and the signal output. The temperature override circuit 38 overrides the primary output signal supplied by the conversion circuit 28 and generates a temperature override signal at a predetermined level as the output signal. This is done in response to the temperature of air being outside at least one predetermined temperature limit. This temperature override signal is provided to the signal output 24 instead of the primary output signal.

In the second embodiment, the at least one predetermined temperature limit is further defined as a maximum temperature limit and a minimum temperature limit. As such, when the temperature of air is above the maximum temperature limit or below the minimum temperature limit, the primary output signal supplied by the conversion circuit is suppressed and the air and the signal conditioner 10 attempts to maintain the air temperature within the maximum and minimum temperature limits. As such, the burner 14 and HVAC system is prevented from damage in the event that the controller 16 should malfunction and provide erroneous signals to the signal conditioner 10.

In the second embodiment, the maximum and minimum temperature limits are adjustable by the user. The minimum temperature limits are settable using a jumper 40 to 40° F., 50° F., or 60° F. The maximum temperature limits are settable using a jumper 42 and a potentiometer 44. Specifically, a maximum temperature range is set by the jumper 42 and the potentiometer 44 is used to set the maximum temperature within that range. The maximum temperature ranges settable using the jumper 42 are 80° F. to 130° F., 110° F. to 160° F., and 150° F. to 200° F. As such, in the second embodiment, the maximum temperature may be set at any temperature between 80° F. and 200° F. Of course, those skilled in the art realize that the minimum and maximum temperature limits may be different in alternative embodiments.

Figure 4A:
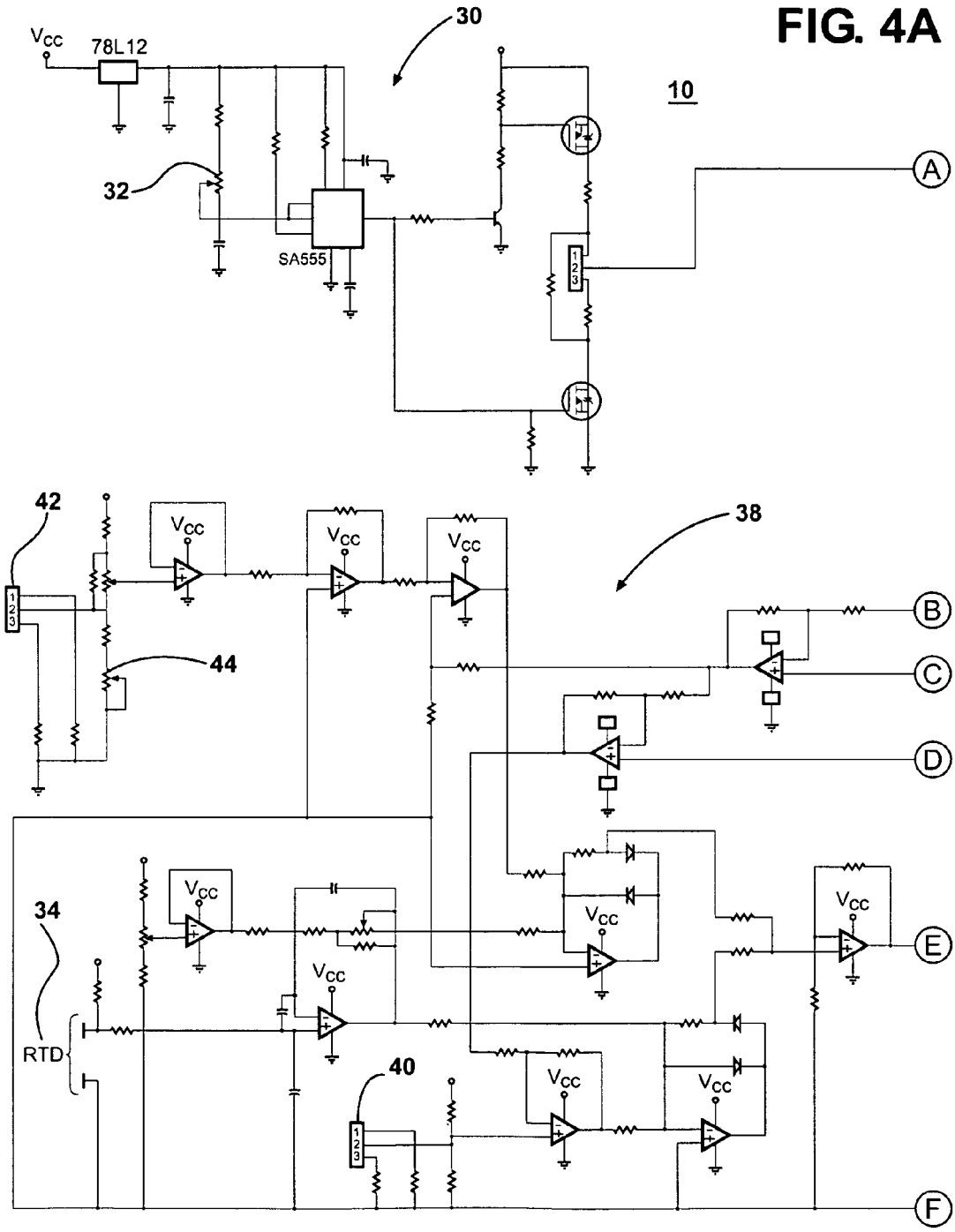
FIGS. 4A and 4B are an electrical schematic of the second embodiment of the signal conditioner.
Figure 4B:
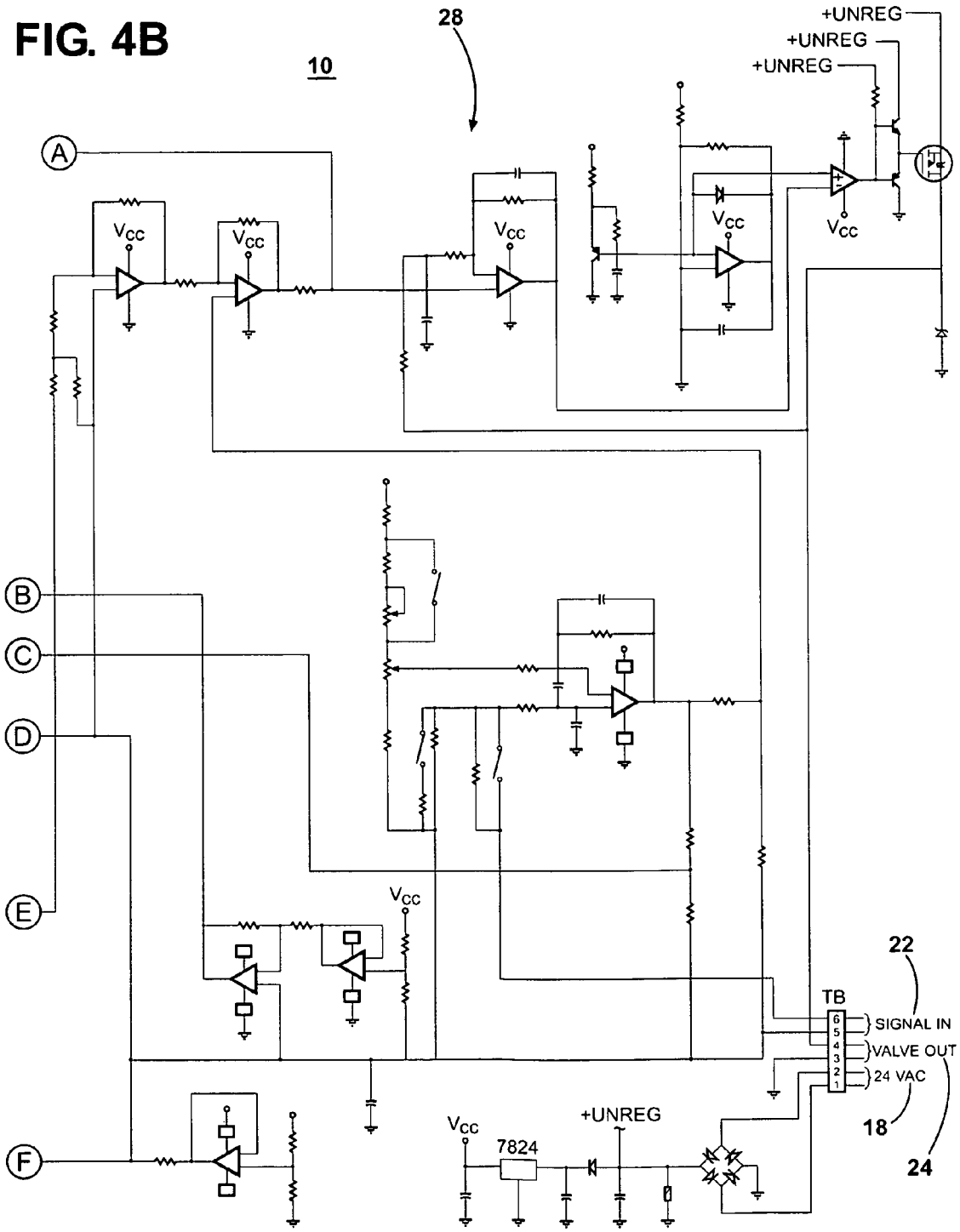

In the illustrated embodiment, as shown in FIGS. 4A and 4B, the circuits 28, 30, 38 of the signal conditioner 10 are implemented using only analog components. That is, no logic-based digital circuitry is utilized. As such, the signal conditioner 10 is very reliable and lacks the faults and errors often associated with digital devices.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A signal conditioner for use with a controller and a burner, said signal conditioner comprising:

a signal input electrically connectable to the controller for receiving a input signal from the controller;

a signal output electrically connectable to the burner for sending an output signal to the burner;

a conversion circuit electrically connected to said signal input and said signal output for generating a primary output signal corresponding to the input signal as the output signal; and a delay circuit electrically connected to said conversion circuit and said signal output for overriding the primary output signal generated by said conversion circuit and generating a delay signal at a predetermined level for a predetermined period of time as the output signal;

the output signal is variable between a low limit and a high limit;

said delay circuit is configurable such that the predetermined level is settable at either the low limit or the high limit.

2. A signal conditioner as set forth in claim 1 further comprising a power supply input for receiving electrical power.

3. A signal conditioner as set forth in claim 2 wherein said delay circuit is also electrically connected to said power supply input and beginning the predetermined period of time when the electrical power is received by said delay circuit.

4. A signal conditioner as set forth in claim 1 wherein the predetermined level is set to a level conducive for ignition of the burner.

5. A signal conditioner as set forth in claim 1 wherein said circuits are implemented using only analog components.

6. A signal conditioner as set forth in claim 1 further comprising a temperature input for receiving a temperature of air discharged from the burner.

7. A signal conditioner as set forth in claim 6 further comprising a temperature override circuit electrically connected to said temperature input and said signal output for overriding the primary output signal supplied by said conversion circuit and generating a temperature override signal at a predetermined level as the output signal in response to the temperature of air being outside at least one predetermined temperature limit.

8. A signal conditioner as set forth in claim 1 wherein the predetermined period of time of the delay signal is adjustable.

9. A method of operating a control system for a gas valve of a burner, the method comprising the steps of:

generating an input signal with a controller based on inputs to the controller;

communicating the input signal from the controller to a signal output of a signal conditioner;

generating a primary output signal corresponding to the input signal with the use of the signal conditioner, the primary output signal being variable between a low limit and a high limit;

communicating the primary output signal from a signal output of the signal conditioner to the gas valve to operate the gas valve according to the primary output signal;

generating a delay signal at a predetermined level;

communicating the delay signal from the signal output of the signal conditioner to the gas valve to override the primary output signal for a predetermined period of time to operate the gas valve according to the delay signal for the predetermined period of time; and selecting the predetermined level of the delay signal from one of the low limit and the high limit.

10. A method as set forth in claim 9 wherein the predetermined period of time is during initial powering of the signal conditioner.

11. A method as set forth in claim 9 further comprising selecting the predetermined period of time.

12. A signal conditioner for use with a controller and a gas burner, said signal conditioner comprising:

a signal input electrically connectable to the controller for receiving an input signal from the controller;

a signal output electrically connectable to the burner for sending an output signal to the burner;

a conversion circuit electrically connected to said signal input and said signal output for generating a primary output signal corresponding to the input signal as the output signal;

a temperature input for receiving a temperature of air discharged from the burner;

a temperature override circuit electrically connected to said temperature input and said signal output for overriding the primary output signal supplied by said conversion circuit and generating a temperature override signal at a predetermined level as the output signal in response to the temperature of air being outside at least one predetermined temperature limit; and a delay circuit electrically connected to said conversation circuit, said temperature override circuit, and said signal output for overriding the primary output signal generated by said conversation circuit and the temperature override signal produced by said temperature override circuit and generating a delay signal at a predetermined level for a predetermined period of time as the output signal;

the output signal is variable between a low limit and a high limit;

said delay circuit is configurable such that the predetermined level is settable at either the low limit or the high limit.

13. A signal conditioner as set forth in claim 12 wherein the at least one predetermined temperature limit is further defined as a maximum temperature limit and a minimum temperature limit.

* * * * *

UNITED STATES PATENT AND TRADEMARK OFFICE

CERTIFICATE OF CORRECTION

PATENT NO. : 9,022,778 B2
APPLICATION NO. : 12/410806
DATED : May 5, 2015
INVENTOR(S) : John James Schlachter and Lynn E. Cooper It is certified that error appears in the above-identified patent and that said Letters Patent is hereby corrected as shown below:

In the claims

Column 6, Claim 12, line 42, “conversation” should read -- conversion --; and

Column 6, Claim 12, line 45, “conversation” should read -- conversion --.

Signed and Sealed this
First Day of December, 2015

Michelle K. Lee

Michelle K. Lee
*Director of the United States Patent and Trademark Office*